United States Patent [19]

Owen

[11] Patent Number: 4,577,803

[45] Date of Patent: Mar. 25, 1986

[54] CONTAINERS

[75] Inventor: David J. Owen, Cleveland, England

[73] Assignee: Imperial Chemical Industries PLC, London, England

[21] Appl. No.: 577,883

[22] Filed: Feb. 7, 1984

[30] Foreign Application Priority Data

Mar. 2, 1983 [GB] United Kingdom ..... 8305816

[51] Int. Cl.[4] ..... B05B 5/02

[52] U.S. Cl. ..... 239/690; 141/17; 141/20; 141/351; 141/383; 222/402.14; 239/337

[58] Field of Search ..... 239/337, 690; 222/402.11, 402.14; 141/17, 20, 351–356, 360–362, 383–386

[56] References Cited

U.S. PATENT DOCUMENTS

| | | | |
|---|---|---|---|
| 3,156,385 | 11/1964 | Yetter | 141/346 |
| 3,885,717 | 5/1975 | Ewald | 222/402.11 |
| 4,209,134 | 6/1980 | Coffee | 239/690 |

*Primary Examiner*—Andres Kashnikow

*Attorney, Agent, or Firm*—Cushman, Darby & Cushman

[57] ABSTRACT

Apparatus, particularly electrostatic spraying apparatus, comprising a container and an enabling device wherein the container has a discharge valve that is held in the closed position by sprung member(s) that can be urged out of engagement, so as to permit valve actuation, upon connection of the enabling device to the container.

9 Claims, 2 Drawing Figures

CONTAINERS

Figure 1:
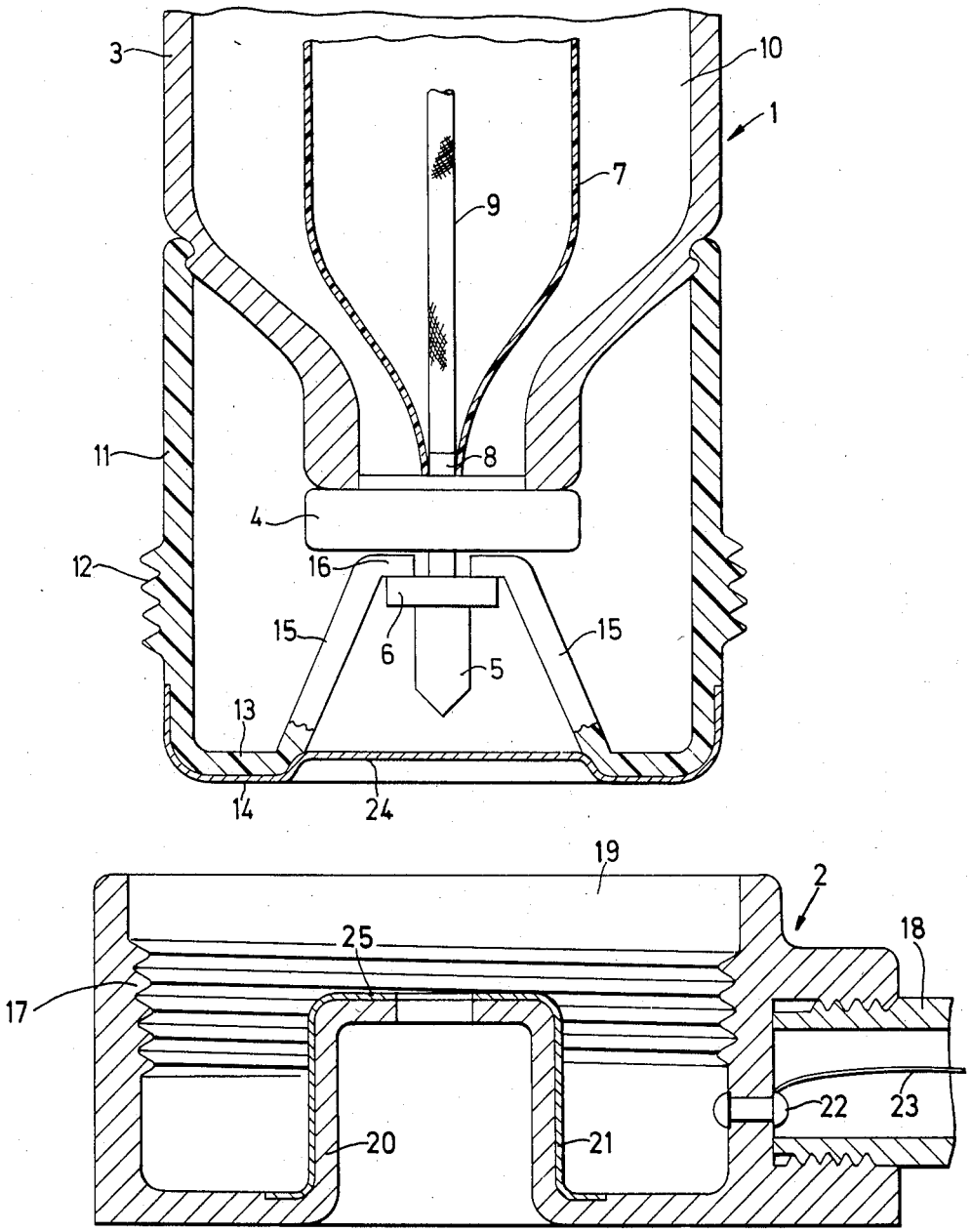

This invention relates to containers and in particular to containers of the type having a body enclosing a reservoir and an orifice for dispensing fluid from the reservoir via a valve between the reservoir and the orifice wherein the valve is of the type in which predetermined relative movement of a valve operating member with respect to the container body causes actuation of the valve.

With such containers the valve is normally biassed to the closed position, and it is desirable to provide a safety device for preventing accidental operation of the valve, particularly where the container contents comprises a flammable, corrosive or toxic material, for example a pesticide.

Accordingly the present invention provides in combination, (a) a container as aforesaid provided with at least one sprung member biassed to engage with the valve operating member to prevent the valve actuating movement, and (b) an enabling device connectable to said container and provided with means for engaging said at least one sprung member to urge the latter out of engagement with the valve operating member.

The enabling device may simply be a reversible cap which, when fitted to the container in one position permits actuation of the valve, and which, when detached from the container, or fitted in the reverse position, causes the at least one sprung member of the container to engage with the valve operating member to prevent the valve actuating movement thereof.

Alternatively the enabling device may form part of an appliance to which the container is connected in use: for example the enabling device may form part of a holder, such as a spray gun, particularly an electrostatic spray gun, to which the container is connected in use. Examples of such container/holder combinations to which the present invention is applicable, are described in U.S. Pat. Nos. 4,209,134, 4,275,846 and 4,306,685 which relate to containers for use for electrostatic spraying.

The valve is preferably of the "aerosol" type wherein depression of a valve operating button axially towards the container causes the valve to be opened and the fluid contents of the container to be dispensed particularly through an orifice formed in the valve operating button. In such a case the sprung member(s) may be biassed to engage between the container body and the valve operating button to prevent such axial movement. Alternatively the valve may be of the "tilt-action" type wherein angular movement of the valve stem from the vertical causes opening of the valve: in this case the sprung member(s) may be biassed to hold the valve stem in the vertical position.

The container is preferably provided with a cap-like extension enclosing the valve operating member with the sprung member(s) within a recess in the cap-like member. The sprung member(s) are preferably inclined inwardly within the recess to engage with the valve operating member.

The enabling device preferably has a projection which, when the enabling device is connected to the container, protrudes into the recess in the cap-like member and engages with the inclined sprung member(s) to urge the latter laterally out of engagement with the valve operating member.

The recess in the cap-like member may be provided with a cover that has to be removed prior to insertion of the enabling device projection into the recess. This cover, which may simply be detached and discarded upon initial use of the combination or which may be replaceable, serves to prevent access to the recess and hence access to the sprung member(s) thus preventing disengagement thereof from the valve operating member prior to connection of the container to the enabling device.

Where the orifice is in a nozzle formed as part of the valve operating member, the enabling device preferably has an opening through which the nozzle can project so that the fluid can be dispensed from the container clear of the enabling device.

The enabling device may be provided with second engaging means positioned for engaging with the valve operating member so that, after the sprung member(s) have been urged out of engagement with the valve operating member so as to permit the desired valve actuating movement of the latter, predetermined movement of the second engaging means relative to the container body effects the desired valve actuating movement of the valve operating member. The second engaging means may be arranged to contact and engage with the valve operating member before the sprung member(s) have been urged out of engagement with the valve operating member. Alternatively, the second engaging means may only engage with the valve operating member after the sprung member(s) have disengaged from the valve operating member. The relative movement between the second engaging means and the container body may be effected by movement of the enabling device relative to the container body: for example where the enabling device is screwthreaded to the container, as the container is screwed into connection with the enabling device, the first engaging means urges the sprung member(s) out of engagement with the valve operating member and then further screw movement effects the valve actuating movement of the second engaging means engaging with the valve operating member. Alternatively the movement of the second engaging means relative to the container body may be effected by movement of a suitable member, e.g. a lever, on the enabling device.

Where the combination of the container and enabling device form an electrostatic spray gun, the discharge orifice of the container is provided in a nozzle, preferably of electrically conductive material, and preferably formed integrally with the valve operating member and to which a suitably high electrical potential can be applied. This potential may be provided by a suitable generator within the enabling device. The enabling device preferably has a body portion of electrically insulating material and the electrical connection from the high voltage source to the nozzle may be provided via an electrically conductive portion of the second engaging means.

The present invention further provides, in addition to the combination of the container and enabling device, the individual component parts, viz containers and enabling devices suitable for use in the combination.

One embodiment of the invention is further described with reference to the accompanying drawings in which FIG. 1 is a sectional elevation of the components of an electrostatic spraying apparatus including a container and a holder, showing the container disconnected from the holder.

Figure 2:
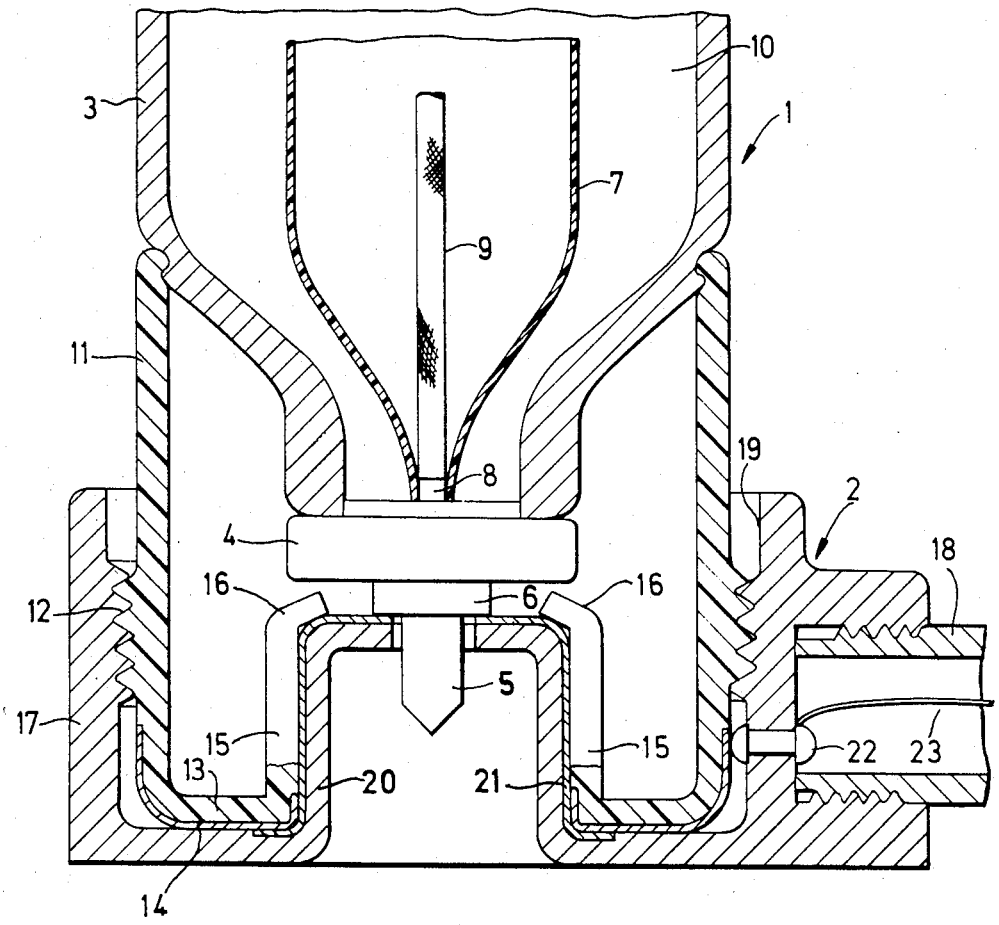

FIG. 2 is a view similar to FIG. 1 showing the container connected to the holder.

The apparatus comprises a container 1 and a holder 2, constituting the enabling device, to which the container may be connected.

The container 1 comprises a body 3 closed by a crimped closure 4 including an "aerosol" type valve having its discharge orifice in a nozzle member 5 which also serves as the valve operating button. Nozzle 5, which has an integral flange 6 around its base, is made of an electrically conductive material. The valve is of the type wherein axial movement of the nozzle 5 towards the closure 4 causes opening of the valve, and the valve is biassed towards the closed position.

Inside the container body 3 there is disposed a flexible bag 7, containing the fluid to be dispensed, fastened to the inlet port 8 of the valve. A gauze tube 9, disposed inside bag 7, is also fastened to inlet port 8 so that the bag 7 cannot neck completely to prevent expulsion of its contents into inlet port 8. The space 10 between the body 3 of the container and the bag 7 is pressurised with a propellant gas, for example compressed air.

Attached to the container body 3 is a cap 11 of non-conductive, e.g. a plastics, material provided with a screw thread 12 whereby the container 1 can be connected to the holder 2. The end 13 of cap 11 remote from container body 3 is provided with a metal foil cover 14 which serves to protect the nozzle 5 during storage of the container 1 prior to its first use. The central.portion 24 of cover 14 covers a recess in cap 11 in which are provided two opposed integral prong-like members 15 inclined inwardly from the end 13 of cap 11 towards the closure 4. The prong-like members 15 terminate in lugs 16 which can engage between flange 6 and closure 4 to prevent axial depression of nozzle 5 towards closure 4. The material from which cap 11 is constructed is of sufficient stiffness that the prong-like members 15 are biassed towards engagement between flange 6 and closure 4 but can be forced out of engagement, as hereinafter described, by screwing container 1 into holder 2.

Holder 2 comprises a housing 17 to which a handle 18 is fitted. The housing 17 has a screw-threaded recess 19 for engagement with the thread 12 of cap 11 of the container 1. The housing 17 also has a central, hollow, projecting cylindrical member 20 into which nozzle 5 of container 1 can protrude and against which the nozzle flange 6 can abut. Cylindrical member 20 is arranged so that, on screwing container 1 to holder 2, cylindrical member 20 engages with the prong-like members 15 forcing lugs 16 out of engagement between flange 6 and closure 4.

A track 21 of electrically conductive material is provided down the surface of cylindrical member 20, and an electrically conductive stud 22 is provided through the wall of housing 17 into the lower part of recess 19. Stud 22 is connected, via lead 23, to a source (not shown) of high electrical potential in handle 18 of holder 2.

In use, the central portion 24 of the metal foil cover 14 of cap 11 is first removed thereby exposing the nozzle 5. Container 1 is then screwed into holder 2. As container 1 is screwed in, the cylindrical member 20 engages the prong-like members 15 to urge lugs 16 out of engagement between closure 4 and flange 6.

On screwing container 1 further into housing 17, the end 25 of cylindrical member 20 engages with flange 6 depressing nozzle 5 thus opening the valve. At the same time the portion of metal foil cover 14 remaining on the end 13 of cap 11 makes electrical contact with stud 22 and track 21 thereby permitting a high potential applied to stud 22 via lead 23 to be conducted to nozzle 5 via track 21 so as to apply the high potential to the fluid material emanating from nozzle 5 thus enabling electrostatic spraying to occur.

In some cases it may be desired that the electrical connection from stud 22 to the nozzle is made only when the valve is open, i.e. when the flange 6 is depressed, while in other cases it may be desired that the electrical connection from stud 22 to the nozzle 5 occurs prior to actuation of the valve. These alternatives can be achieved by appropriate positioning of the conductive tracks 14 and 21 on cap 13 and projection 20.

Thus, by arranging that track 14 only contacts stud 22 and/or track 21, when the flange 6 is in the depressed position, the electrical potential applied to stud 22 is only applied to nozzle 5 when the valve is open.

The electrostatic spray gun may be provided with an earthed electrode (not shown) positioned in the enabling device but insulated from the nozzle. This earthed electrode can act as a field adjusting electrode as described in U.S. Pat. No. 4,356,528.

I claim:

1. A combination, comprising:

(a) a container having:

(i) a body enclosing a reservoir, (ii) a nozzle providing an orifice for dispensing a fluid from said reservoir, (iii) a valve, biassed to the closed position, between said reservoir and said orifice, (iv) a valve operating member incorporating said nozzle, said valve being actuatable by effecting predetermined relative movement between said valve operating member and said body, and (v) at least one sprung member biassed to engage with said valve operating member to prevent said predetermined relative movement, and (b) an enabling device connectable to said container and provided with:

(i) first engaging means for engaging with said at least one sprung member to urge the latter out of engagement with said valve operating member, and (ii) an opening through which said nozzle is exposed when said enabling device is connected to said container.

2. A combination according to claim 1 wherein said predetermined relative movement is movement of said valve operating member towards said body and said at least one sprung member is biassed to engage between said valve operating member and said body.

3. A combination according to claim 1 wherein said container has a cap member extending beyond said valve operating member and containing said at least one sprung member, said at least one sprung member being biassed to incline inwardly to engage with said valve operating member.

4. A combination according to claim 3 wherein said cap member has a recess for receipt of a projection of said enabling device, said projection forming said first engaging means and being disposed such that, upon connection of said enabling device to said container, said projection engages with said at least one sprung member to urge the latter laterally out of engagement with said valve operating member.

5. A combination according to claim 3, wherein:

said cap member has a recess for receipt of a projection of the enabling device, said recess being covered by a detachable covering member which must be detatched before said projection can be received in said recess.

6. A combination according to claim 1 wherein said enabling device is provided with second engaging means, said second engaging means being disposed for engagement with said valve operating member such that, after connection of said enabling device to said container so that said first engaging means urges said at least one sprung member out of engagement with said valve operating member, predetermined movement of said second engagement means relative to said container body causes said second engaging means, in engagement with said valve operating member, to effect said predetermined movement of said valve operating member relative to said container body to actuate said valve.

7. A combination according to claim 1 in the form of an electrostatic spray gun wherein said orifice is formed in a nozzle member of electrically conductive material, and said enabling device comprises a body member of electrically insulating material for connection to said container and means to apply to said nozzle member a high electrical potential.

8. A combination according to claim 7 wherein said enabling device includes second engaging means to engage with said valve operating member whereby movement of said second engaging means relative to the container body effects said predetermined movement of the valve operating member to actuate the valve and said second engaging means has an electrically conductive portion for engagement with said valve operating member whereby engagement of said electrically conductive portion with said valve operating means provides electrical connection for the high electrical potential from a source thereof to said nozzle.

9. An enabling device for use with a container which includes:

(i) a body enclosing a reservoir, (ii) a nozzle providing an orifice for dispensing fluid from said reservoir, (iii) a valve, biassed to a closed position between said reservoir and said orifice, (iv) a valve operating member incorporating said nozzle, said valve being actuable by effecting a predetermined relative movement between said valve operating member and said body, (v) at least one sprung member biassed to engage with said valve operating member to prevent said predetermined relative movement, said enabling device comprising:

(i) means for engaging said at least one sprung member in an urging relationship to urge said at least one sprung member, against its bias, out of said relative movement-preventing engagement, while leaving said orifice of said nozzle exposed; and (ii) means for connecting said engaging means with said container, this connecting means being constructed and arranged to consequentially bring said engaging means into said urging relationship with said at least one sprung member upon completion of connection of said engaging means with said container.

* * * * *